US005428846A

United States Patent [19]

Socci et al.

[11] Patent Number: 5,428,846

[45] Date of Patent: Jul. 4, 1995

[54] BATTING TRAINER

[75] Inventors: Roger D. Socci, Reston; John R. Hackworth, Norfolk, both of Va.

[73] Assignee: Creative Sports Design, Inc., Reston, Va.

[21] Appl. No.: 202,765

[22] Filed: Feb. 28, 1994

[51] Int. Cl.[6] ..... A42B 3/00; A63B 69/00

[52] U.S. Cl. ..... 2/425; 273/26 C; 434/247

[58] Field of Search ..... 2/425, 422, 8; 434/252, 434/258, 247; 273/26 C, 26 R

[56] References Cited

U.S. PATENT DOCUMENTS

| | | | |
|---|---|---|---|
| 4,300,765 | 11/1981 | Stringham | 273/26 C |
| 4,502,035 | 2/1985 | Obenauf et al. | 434/252 X |
| 4,527,982 | 7/1985 | Salzman et al. | 434/252 |
| 4,605,226 | 8/1986 | Morrissey | 273/26 C |
| 4,826,165 | 5/1989 | Socci | 273/26 R |
| 5,108,104 | 4/1992 | Johnson | 434/252 |
| 5,324,038 | 6/1994 | Sasser | 434/252 X |
| 5,380,001 | 1/1995 | Socci et al. | 273/26 C |

*Primary Examiner*—Peter Nerbun

*Attorney, Agent, or Firm*—Armstrong, Westerman, Hattori, McLeland & Naughton

[57] ABSTRACT

The present invention is concerned with a device for aiding the teaching and training techniques for hitting a baseball accommodating different initial head position and batting style, comprising: a helmet fitted with a mercury switch connected to a motor; a nulling circuit which sets the positional angle of the mercury switch, a tone generator control which activates a tone generator and notifies the batter; two magnetic switches located on each side of the helmet; and, a magnet located on the batter's shirt and a power supply.

5 Claims, 3 Drawing Sheets

BATTING TRAINER

FIELD OF THE INVENTION

The present invention relates to a batting aid for baseball players. More particularly, the present invention relates to a device which aids in the training and teaching of hitting techniques in baseball by accommodating different initial head position and batting styles.

BACKGROUND OF THE INVENTION

Numerous techniques have been developed to improve the ability of a player to hit a ball with a bat, club, racket or other implement. Generally, these techniques rely upon a repetitive practice routine of swinging at the ball. In the case of baseball players, batting tees, batting practice machine and pitchers have been used to improve a batter's swing and hitting ability. While these techniques have been useful, the degree of success with all players has not been particularly great. Further, relatively long periods of time are required with proper instructions to perfect one's ability through constant practice.

Numerous articles have also been published on methods for improving hitting. For example, *THE ART OF HITTING* by Charley Lau with Alfred Glossbrenner (1980) discloses the movement of the head during hitting. *THE SWING'S THE THING* by Ben Hines and Bob McBee (1985) teaches chin and shoulder movement, the fulcrum position, bringing the barrel of the bat in a downward plane into the baseball, and the turning of the head.

It has been well established in the art that proper head to shoulder transfer and movement through the swing is critical in achieving solid contact with the ball in transferring maximum force so as to hit the ball as far as possible. U.S. Pat No. 4,605,226 by Morrissey discloses a training device to be used in the sport of baseball and the like which enables the user to improve his hand-eye coordination and to maximize the head to shoulder transfer. The device of Morrissey is mounted on a protective helmet, said device comprising a shield having a top flange and a main opaque body releasably mounted on a protective helmet on the side opposite the source of the projectile travelling towards the user. In the case of baseball, the user's head being out of the desired position will result in a shielding of the eyes of the user from the projectile.

U.S. Pat No. 4,300,765 by Stringham discloses a batting aid which is comprised of a shoulder piece for positioning on the shoulder of the batter, a jaw piece for positioning against the jaw of the batter and the means which connects the shoulder piece and jaw piece together in a spaced relation to each in order to impede movement of the jaw of the batter towards the shoulder during a swing.

U.S. Pat. No. 4,502,035 by Obenauf et al. teaches means by which a golfer is provided direct real time feedback on the occurrence and severity of his head movement as the golfer swings at a golf ball. This is accomplished by affixing to the golfer's head, a piezoceramic bender element which senses vertical and horizontal motion in a vertical plane running through the golfer's body, head, shoulder and arms. The movement of the golfer's head is sensed by a motion sensor which generated an electrical signal wherein the magnitude of the signal is relative to the magnitude of the acceleration of the golfer's head. This electrical signal is conveyed by wires to a signal processor which converts the electrical signal received to a second electrical signal which has an amplitude which is a function of the magnitude of the acceleration sensed. This signal is then directed to an audio output which alerts the user of his body position.

Since the motion sensor of Obenauf et al. senses both vertical and horizontal movement and the alarming device or noise frequency does not differentiate the vertical and horizontal movement, then it becomes very difficult for the user to differentiate for example in the case of a higher frequency, whether or not the deficiency is as a result of the user's faster or higher head movement acceleration. Also, the continuous audio output device often times affects the user concentration and detracts from his efficient performance. Lastly, Obenauf et al. does not address the adaptability of this device to the different body forms of the users. Because of the variety of body form of the golfers the acceptability of any device is dependent upon the ability of the device to adapt to the different body structure and form. Odenauf et al. has no such adaptability and will ultimately result in difficulty for a wide variety of users.

Also, U.S. Pat. No. 5,108,104 by Johnson discloses a device for training a golfer to maintain a head-down position during a golf swing. This is accomplished by utilizing a small enclosure containing a mercury filled electrical switch, an audible alarm such as a piezo buzzer, circuitry for sounding the audible alarm, and a battery. When activated visa power switch, the device sound the audible alarm if the mercury switch detects that the golfer has raised his head for a significant length of time during the swing.

Further, U.S. Pat. No. 4,826,165 by Roger Socci disclosed a device which teaches a method for hitting a baseball. In Socci the batter is fitted with a cumbersome shoulder harness with a chin holder connected thereto in a manner to allow for movement of the chin holder on a plane from the right shoulder to the left shoulder in an elliptical fashion. Though Socci teaches a workable training module, the device itself, however, is impractical and cumbersome.

The present invention gives a batter instant audio feedback to let him know if his head is in the correct position when he is in the process of swinging. If a batter puts his head down at the precise point and time of contact, he can be assured his head was in the right position through both this decisive moment and for tracking the ball to the point of contact. But if a batter pulls off the ball laterally and puts his head down at the same time, the device of the present invention will notify the batter of his incorrect position. As Mike Toomey, a scout with the San Francisco Giants says, "the most pronounced problem is still the ability to control the head and see the ball". The time-worn cliches in baseball of "keep your head in there", and "keep your eye on the ball" will become unnecessary after continuous practice and training with the devise of the present invention. Muscle memory for the correct head position in the swing process becomes automatic after repeated use of the subject batting trainer.

It is therefore, an object of the present invention to provide a very simple device to teach baseball players the correct method for hitting a baseball.

Another object of the present invention is to provide a batting aid for a baseball player which will enable the batter to keep his head and front shoulder in the correct position when hitting a baseball.

A further object of the present invention is to provide a simple hitting device which can be adjusted to accommodate different initial head positioning and batting styles.

Still a further object of the present invention is to provide a device which senses the relationship of a baseball batter's head and shoulder during the swing and conveys same to the batter.

These and other object of the present invention will become more apparent as you proceed through the detailed description.

SUMMARY OF THE INVENTION

The present invention teaches a device for training baseball batter in assuming the correct head motion during the swing comprising; a helmet fitted with a mercury switch attached to a motor in a manner whereby said motor adjusts the position of the said mercury switch; a nulling circuitry which sets the positioning angles of the mercury switch by causing the motor to move said switch in a first home direction until the mercury switch opens and until a home switch is activated, said activated home switch causing the motor to reverse its direction until the mercury switch closes; a tone generator control which switches on a tone generator when the mercury switch opens and switches off the tone generator when the mercury switch closes; magnetic switches located on the sides of the helmet and connected to the tone generator control which detects tilting of the helmet from side to side; magnets located on the batters shirt which activate the magnetic switches located on the side of the helmet; and, an electrical power supply with sufficient electrical energy to activate the nulling circuit.

DETAILED DESCRIPTION OF THE INVENTION

A baseball batter's head position in his preparatory stance (batting stance) is somewhat different from his head position during the swing process. During the preparatory stance, a batter's head and chin are on or near his front shoulder. The head and chin should bend or tilt down on the swing and end up on the rear shoulder after the swing before the batter looks to see where the ball was hit.

The device of the present is designed to accommodate different initial head position by finding the starting position of the helmet which is different for each batter and will vary based upon the batter's style.

Figure 1:
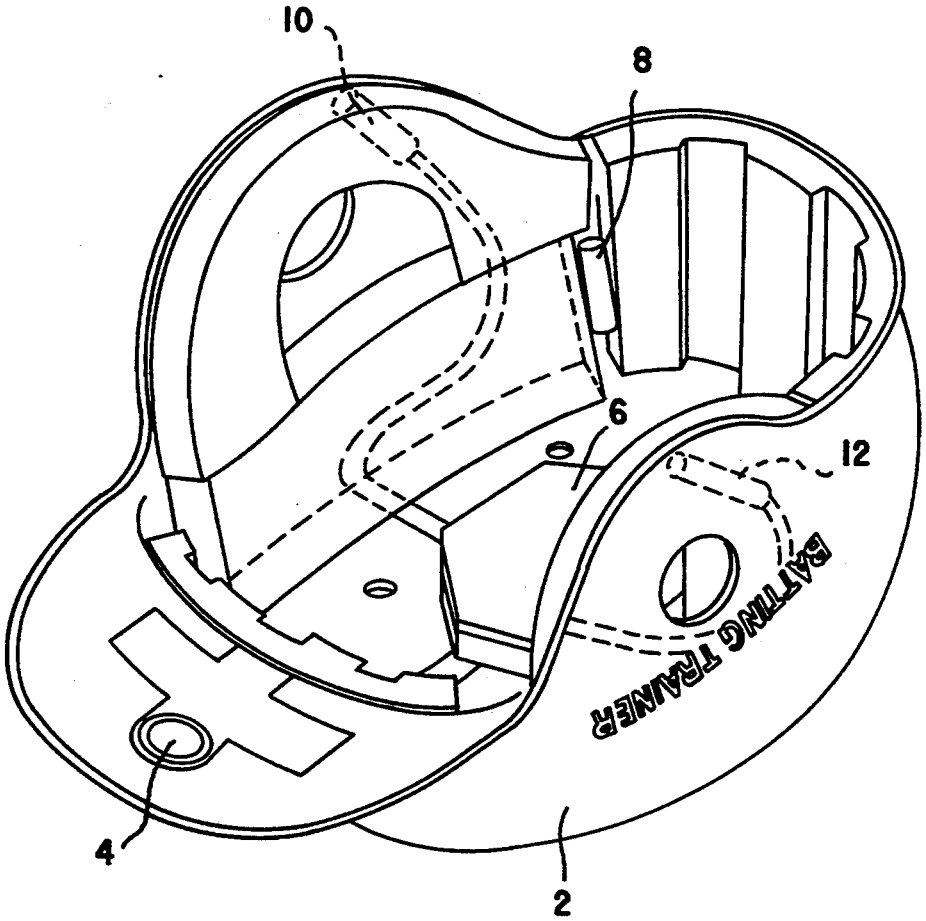
FIG. 1 is a underside view of the batter helmet showing the functional mechanism of the present invention assembled therein.

FIG. 1 illustrates the device of the present invention housed within the helmet 2 and is incorporated as an integral part of helmet 2 which makes it generally not visible unless the helmet is removed and examined. Typically, the batter would wear this helmet in the same manner he would wear a helmet not equipped with the device of the present invention. FIG. 1 also illustrates null touch switch 4 located on the brim of the helmet; mercury switch and motor 6 located in the top of the helmet; tone generator 8 located on the left side of the helmet towards the rear; magnetic side switch 10 located on the left side of the helmet; and, magnetic side switch 12 located on the right side of the helmet. The location of these functional units within the helmet is not critical provided however, they are located in a manner that does not affect their functionality nor the use of the helmet by the batter.

Figure 2:
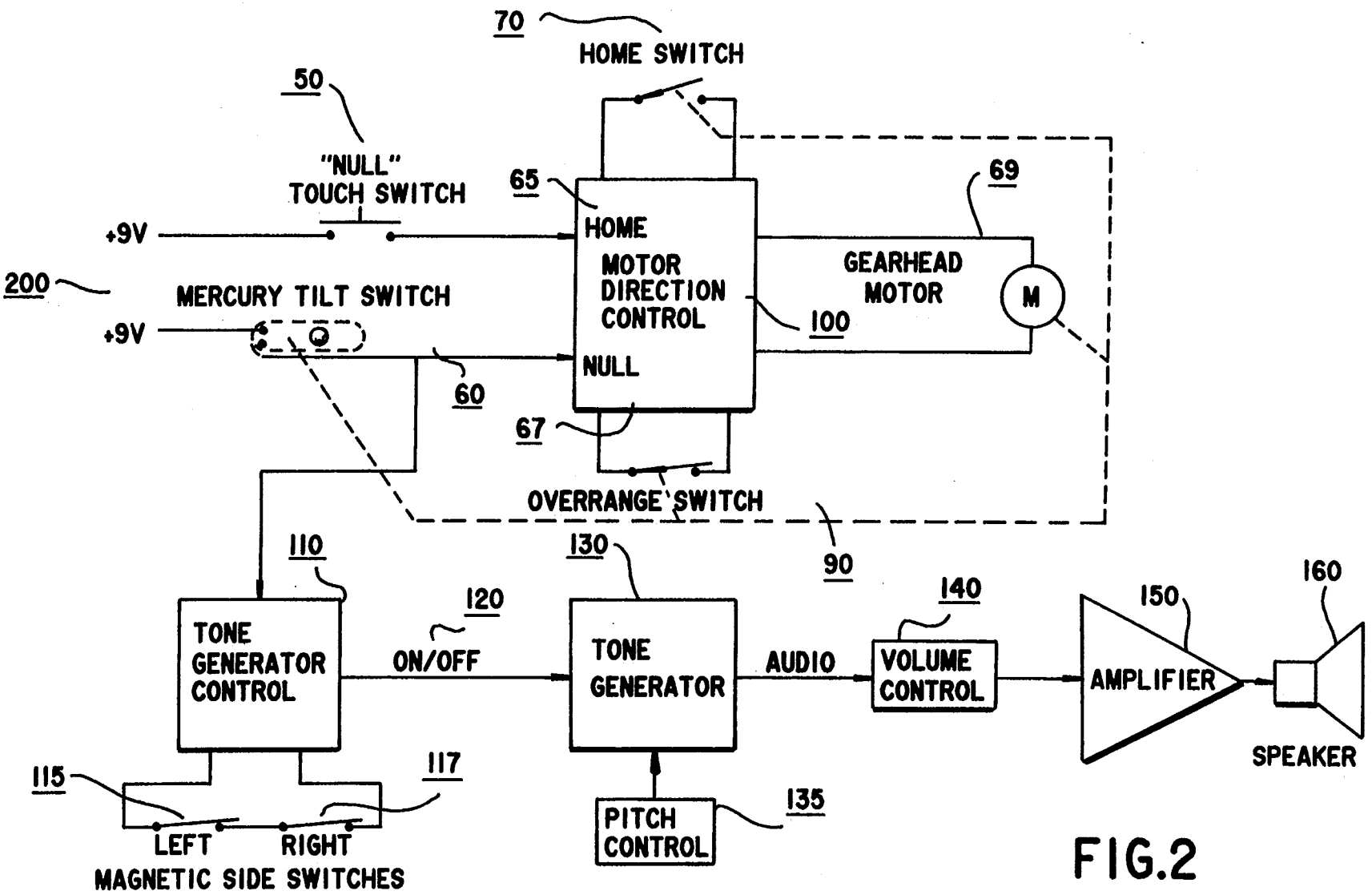
FIG. 2 is a schematic block diagram of an electrical circuit of the invention.

FIG. 2 illustrates an electrical block diagram showing the nulling circuitry and its functional units. The purpose of the nulling circuitry is to set the positioning angle of mercury switch 60 such that switch 60 is just closed. This is done by attaching switch 60 to the shaft connected to gearhead motor 69. The gearhead reduces the motor's shaft speed, which in turn, increases the positioning accuracy. Gearhead motor 69 allows the motor to adjust the position of mercury switch 60. Motor 69 is mounted in the top of the helmet and is oriented such that mercury switch 60 will tilt in the frontward and backward direction to an angle of up to 45 degrees.

When null touch switch 50 located on the bill of the helmet is depressed, the motor direction control circuit 100 starts motor 69 in the direction of home 65 while monitoring the status of home switch 70. While the system is "homing", switch 60 opens which causes tone generator control 110 to switch on tone generator 120. Motor 69 continues to turn until a small cam on motor 69 shaft depresses home switch 70. This occurs at approximately 45 degrees.

When home switch 70 is depressed by the cam, motor direction control reverses 100 reverses the direction of motor 69 and slows its speed. At this time, motor direction control 100 continuously monitors mercury switch 60. When switch 60 closes, motor direction control 100 turns off all power to motor 69, which freezes the position of mercury switch 60. At the same time, tone generator control 110 switches off power to tone generator 120.

Figure 3:
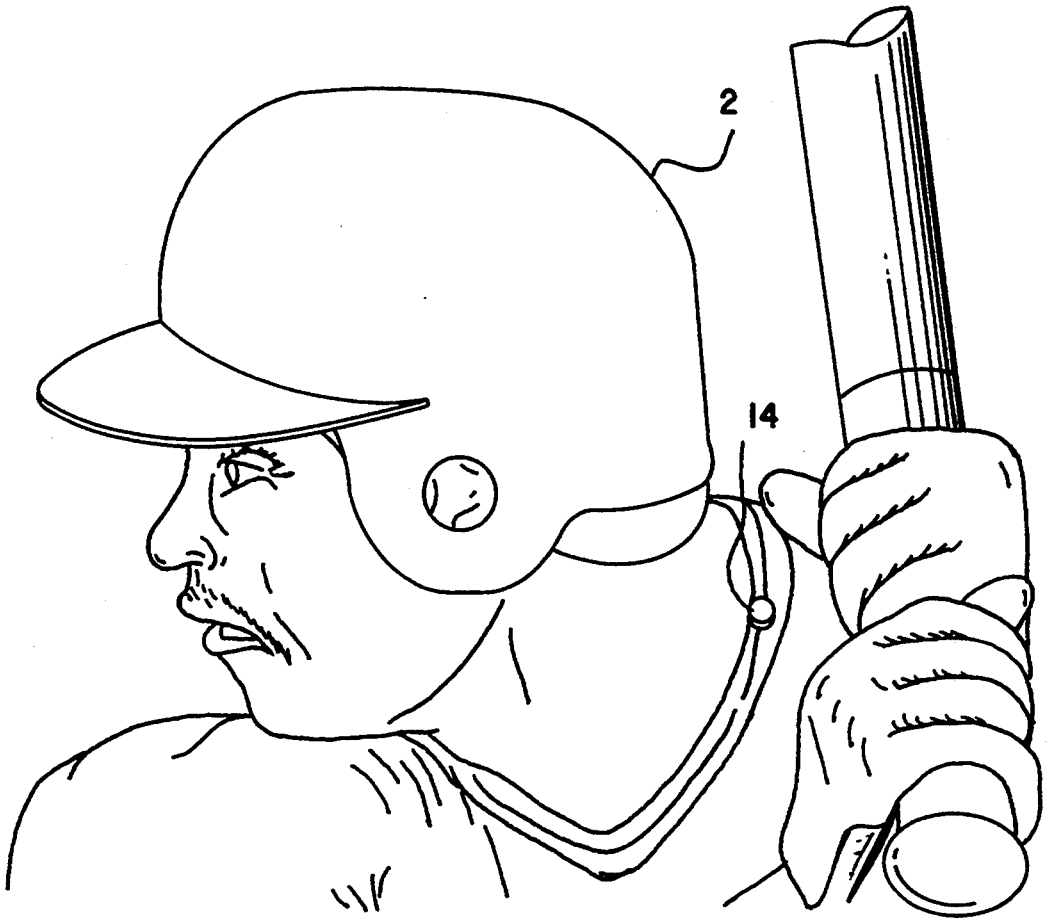
FIG. 3 is a side view of a batter wearing a helmet according to the present invention.

As the batter tilts his head down slightly for the pitcher's pitch, mercury switch 60 opens causing the tone to come on. From this point, if the batter is batting correctly, the tone should stay on. It the batter tilts his head back, mercury switch 60 will close interrupting the tone. If the batter tilts his head from side to side, one of the magnetic side switches 115 and 117 will sense a small magnet 14 attached to the batter's shirt collar (see FIG. 3) which also interrupts the tone.

The present invention also incorporates overrange switch 90 which shuts down the system when the helmet is in a position that the mercury switch 60 cannot close, i.e., a null point or nulled position of the helmet cannot be reached. If null touch switch 50 is depressed while the helmet is upside down, i.e., helmet is removed from the head and placed upside down on a surface, the circuit will never find a null point. In this case the motor 69 continues to search for the null point until, at an extreme angle of rotation, it finally depresses overrange switch 90. When this occurs, power is removed from the motor and the circuit awaits another null command from null touch switch 50.

Connected to tone generator 130 is switch 120 which can be used, if desired, to turn off the sound to the batter. The tone of the sound can also be controlled by pitch control 135. The intensity of the tone heard by the batter is controlled by control 140 . The tone passes from volume control 140 into amplifier 150 and to speaker 160. Speaker 160 is positioned within the helmet in a manner to allow easy access of the tone to the batter.

Also, located within the helmet is electrical power supply 200 which should be of sufficient voltage to provide suitable amounts of electrical energy to power the circuitry and the motor. Typically, a 9 volt battery is utilized as a primary power source. The type of battery is generally not critical. However, longer life batteries such as lithium batteries are preferred. Other power sources may be utilized, provided that such power source is compatible with that which is utilized in the present invention. The location of the electrical power supply is generally not critical. However, care should taken to locate the power supply in an accessible location within the helmet.

This the invention has been described with reference to a preferred embodiment, it is to be clearly understood by those skilled in the art that the invention is not limited thereto. Other electrical circuits and functional units may be contemplated as being within the spirit and scope of the present invention. Accordingly, it is not intended that the invention be limited, except as by the appended claims.

What is claimed is:

1. A device for training a baseball batter in assuming a correct head motion during swinging of a bat, the device comprising:

a helmet fitted with a mercury switch attached to a motor in a manner whereby said motor is capable of adjusting position angles of said mercury switch with respect to said motor;

a nulling circuit which sets the positioning angles of the mercury switch by causing the motor to move said switch in a first home direction until the mercury switch opens and until a home switch is activated, said activated home switch causing the motor to reverse its direction until the mercury switch closes;

a tone generator control which switches on a tone generator when the mercury switch opens and switches off the tone generator when the mercury switch closes;

magnetic switches located on the sides of the helmet and connected to the tone generator control, the magnetic switches for detecting tilting of the helmet from side to side; and an electrical power supply with sufficient electrical energy to activate the nulling circuit.

2. A device according to claim 1 further comprising an overrange switch which removes power from the nulling circuit when the circuit is unable to find a null point.

3. A device according to claim 1 further comprising a motor direction control circuit which controls the direction of the motor, monitors the direction of the mercury switch and the status of the home switch.

4. A device according to claim 1 wherein the motor is mounted in the helmet and oriented such that the mercury switch tilts in frontward and backward direction to an angle of up to 45 degrees.

5. A device according to claim 1, further including magnets located on a shirt of the batter which are adapted to activate the magnetic switches.

* * * * *